United States Patent [19]

Hedin

[11] 4,086,068

[45] Apr. 25, 1978

[54] LENS GRINDING AND POLISHING LAP COVER AND METHOD OF MAKING SAME

[75] Inventor: David C. Hedin, Grant Township, Washington County,, Minn.

[73] Assignee: Minnesota Mining and Manufacturing Company, Saint Paul, Minn.

[21] Appl. No.: 786,027

[22] Filed: Apr. 8, 1977

[51] Int. Cl.[2] ..... B24D 11/02

[52] U.S. Cl. ..... 51/395; 51/297; 51/405; 51/407; 51/DIG. 34

[58] Field of Search ..... 51/394–402, 51/405–407, 209 DL, 284, 297, 298 R, DIG. 34; 76/101 R

[56] References Cited

U.S. PATENT DOCUMENTS

| | | | |
|---|---|---|---|
| 2,282,650 | 5/1942 | Fenton | 51/396 |
| 3,144,737 | 8/1964 | Faas | 51/395 |
| 3,583,111 | 6/1971 | Volk | 51/DIG. 34 |
| 3,699,721 | 10/1972 | Beasley | 51/DIG. 34 |
| 3,959,935 | 6/1976 | Stoppacher | 51/DIG. 34 |
| 3,990,329 | 11/1976 | Laurin | 76/101 R |
| 4,019,289 | 4/1977 | Korver | 51/DIG. 34 |

*Primary Examiner*—Harold D. Whitehead
*Assistant Examiner*—Nicholas P. Godici
*Attorney, Agent, or Firm*—Cruzan Alexander; Donald M. Sell; Richard Francis

[57] ABSTRACT

A lap cover for a curved surface lens grinding tool or lap comprises an elongate body portion having a leading end and a terminal end and a plurality of spaced integral elongate appendage portions projecting from the edges of the body portion. The shape of each appendage portion is such that the appendage portions do not tear away from the body portion of a lap cover which is adhesively bonded to a lap surface when the leading end of the elongate body portion of the lap cover is stripped back toward its terminal end during removal.

16 Claims, 4 Drawing Figures

LENS GRINDING AND POLISHING LAP COVER AND METHOD OF MAKING SAME

BACKGROUND OF THE INVENTION

1. Field of the Invention

The present invention relates to an improved lens grinding lap cover. In another aspect, this invention relates with a method of preparing the novel lap cover.

2. Description of the Prior Art

The process of lens grinding and polishing has been carried out, according to recorded reports, for nearly four centuries. In the process, slabs of optical material, such as glass or optical grade plastic, are cut with a saw or slitting disc, formed into a desired shape by chipping or heating to a conformable consistency and pressing in a mold to produce a lens blank. The surfaces of the lens blank are then ground, or lapped, to the desired form on a cup-shaped iron tool or lap of the correct curvature, if the lens is convex, or on a dome-shaped tool or lap, if the lens concave. Early methods involved supplying abrasive slurry to the lap-lens interface for grinding and polishing which did not prevent the concomitant erosion of the lap surface from the required curvature. Recent developments included the use of an overlay or lap cover, shaped to conform to the curved surface of the lap, which protects the lap surface and prevents destruction of its curvature. Such lap covers may have an abrasive coating provided by a permanent coating of a mixture of a resin binder and abrasive particles or by supplying abrasive particles in a liquid vehicle (employing a foil or fabric-type lap cover) during the lapping operation.

Such lap covers are known in any of a wide variety of shapes. For example, Stoppacher (U.S. Pat. No. 3,959,935) discloses a cover shaped somewhat like a modified four leaf clover. Faas (U.S. Pat. No. 3,144,737) discloses a similar abrasive lap cover. Fenton (U.S. Pat. No. 2,282,650 and 2,309,836) discloses lap covers having a plurality of petals or leaves emanating from a central connecting portion. Hoenig (U.S. Pat. No. 3,324,608) discloses a generally circular shaped lap cover having four equally spaced radial slots. U.S. Pat. No. 3,699,721 discloses a slotted distorted cross-shaped lap cover.

Each of these lap covers suffers from a common deficiency. None can be cleanly stripped in one piece from the lap surface by merely detaching one portion of the lap cover in stripping off the entire lap cover. Most require detachment of two appendages or more before the entire lap cover can be removed from the surface to which it is attached and even then it often cannot be removed in one piece. This is both inconvenient and time-consuming.

Another common problem associated with the lap covers of the prior art is the considerable amount of waste material (or "weed" as it is called in the art) left after each lap cover is cut from a bulk sheet. None can be cut to minimize this waste. The lap cover configurations of the prior art not only produce considerable waste or weed but their complex shapes make them much more difficult to convert (i.e., cut and separate from the weed), increasing their production costs and time.

SUMMARY OF THE INVENTION

The present invention provides a novel lap cover which avoids the problems discussed above because it can be easily and cleanly removed from the lap surface in one piece by merely detaching the leading end and stripping the lap cover toward the terminal end. The lap cover of this invention has a generally elongate body portion having a leading end and a terminal end and a plurality of spaced integral elongate appendage portions projecting from the edges of the body portion conforming readily to typical curved lap surfaces. The shape of each of the appendage portions is such that the appendage portions of an adhesively bonded lap cover do not tear away as the leading end of the body portion is stripped back toward the terminal end. This novel configuration provides a clean-stripping easily removable lap cover and its configuration is conducive to conversion with a minimum of waste material or weed and with much more ease than lap cover configurations of the prior art.

The features of the lap cover of the invention will be more readily comprehended by the following detailed description of the invention taken in conjunction with the accompanying drawings, wherein like numerals are employed to designate like parts.

The Drawings

DETAILED DESCRIPTION OF THE INVENTION

Figure 1:
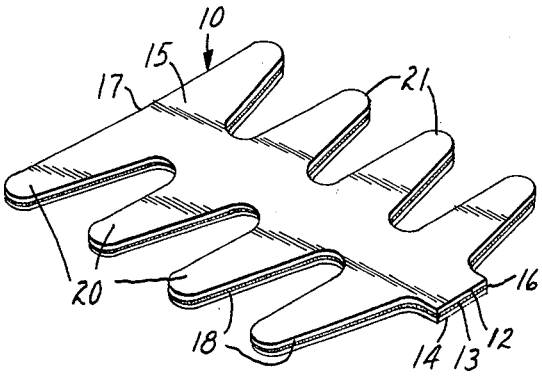
FIG. 1 is a perspective view of a lap cover according to the invention.

Referring to the drawings, and more specifically to FIG. 1, there is shown a lap cover 10 consisting of a conformable sheet 12 such as paper, polymer, cloth or a nonwoven fabric and an adhesive coating 13 of adhesive material suitable for fastening the lap cover to the curved surface of the lap and maintaining the adhesive bond during the entire lapping operation, and, optionally, a protective release liner 14 over the surface of the adhesive to facilitate storage and handling of the adhesive coated lap prior to use. The conformable sheet may be coated with a mixture of abrasive particles and a suitable bonding material or may merely be a foil or a fabric (which may be flocked) to provide lap cover to which a slurry of abrasive particles in a liquid vehicle is applied during the lapping operation.

Figure 3:
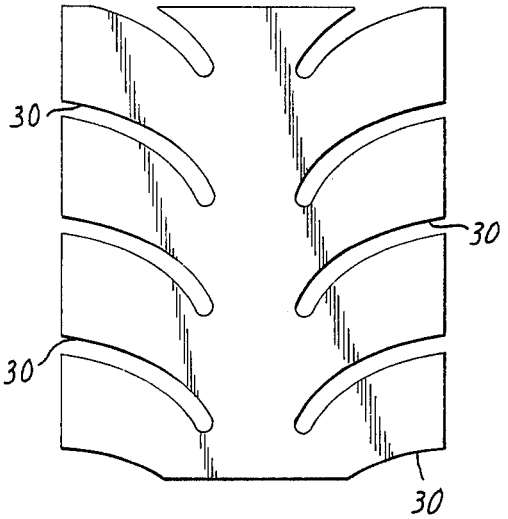
FIG. 3 is a plan view of another embodiment of the lap cover of the invention.
Figure 2:
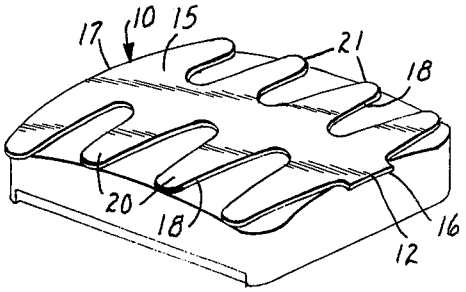
FIG. 2 is a perspective view of a convex lens grinding lap with the lap cover of FIG. 1 in place thereon.

The lap cover 10 of the invention is characterized by having an elongate body portion 15 which has a longitudinal axis within the elongate body portion, a leading end 16 and a terminal end 17 and a plurality of spaced integral appendage portions 20. The ends of the slots between appendage portions define the side edges of the elongate body portion 15. The side edges do not cross the longitudinal axis. The shape of each appendage portion 20 is such that a lap cover adhesively bonded to a lap surface can be removed without detachment of the appendage portions by detaching leading end 16 and stripping toward terminal end 17. Generally, the included angle between the leading edge 18 of each appendage portion 20 and the longitudinal axis of the body portion 15 is 90° or less, preferably less than 80°. For lap covers formed with a fabric-type substrate sheet, the included angle between the leading edge 18 of each appendage portion 20 and the longitudinal axis of the body portion 15 may be as great as 125°. The leading edge 18 is preferably a straight edge or a gradually curving edge, as shown in FIG. 3 (by reference numeral 30). Any part of a gradually curving leading edge generally should have an included angle between its tangent and the longitudinal axis of the elongate body portion to which it is attached of 90° or less, preferably 80° or less, although for lap covers having a fabric-type substrate sheet this angle may be as great as 125°.

Most preferably, the juncture where the leading edge and the edge of the elongate body meet is curved to prevent tearing as the lap cover is stripped from the lap surface. If the included angle between leading edge 18 and the longitudinal axis of elongate body portion 15 is between 80° and 125° the radius of curvature at the juncture of the leading edge and the edge of the elongate body portion is preferably at least about 3/16 inch to prevent tearing.

Figure 4:
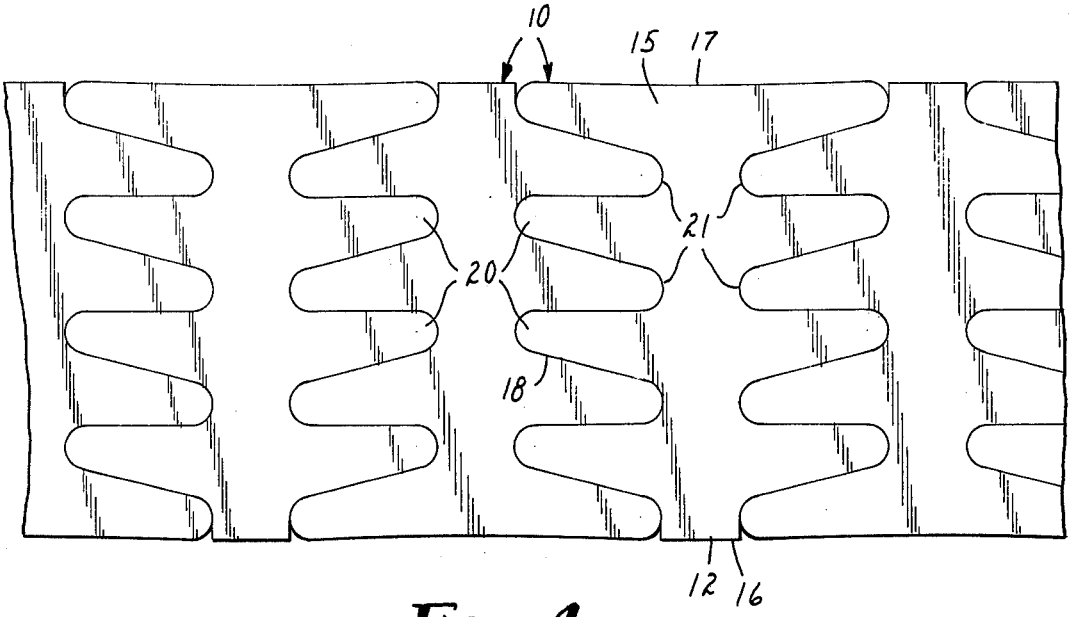
FIG. 4 is a plan view of a continuous strip of lap covers of the type depicted in FIG. 1, the lap covers being cut but not separated.

The preferred lap cover of the invention has a shape corresponding to that depicted in FIG. 1 having opposed appendage portions 20 with generally rounded ends 21 with complementary slots between appendage portions so that a number of such lap covers may be cut from a single strip of material with little or no waste (or weed) as depicted in FIG. 4 which shows a strip of cut lap covers before separation.

The dimensions of the lap cover of the invention will vary widely depending upon the size of the lens being ground and upon the equipment being employed. The selection of the particular materials and the various thicknesses is well within the skill of the art, depending upon the lens being ground, the finish required and upon the apparatus employed.

The adhesive coating on the lap cover of the invention may be any one of many known for use in adhering such devices to the lap surface. The preferred adhesive, as previously mentioned, is a pressure-sensitive adhesive such as those based on rubber:resin, acrylates or acrylate copolymers.

The adhesive coating is conveniently applied by any known method such as laminating, roll or spray coating etc. The preferred method of applying adhesive is by using double coated pressure-sensitive adhesive tape, i.e., tape that has pressure-sensitive adhesive on both of its surfaces. A suitable commercially available example of such a tape is that sold by the 3M Company as "Scotch" 442DCY double coated tape.

An abrasive coated lap cover according to the invention is conveniently prepared by first taking a sheet or substrate from which lap covers will be cut, coating it with a mixture of abrasive particles and liquid curable binder, and curing the binder. The abrasive coated sheet is then coated with adhesive, e.g., by adhering the double coated tape to the surface opposite that coated with abrasive. This tape may have a release liner on its non-adhered surface. The adhesive coated sheet is then cut to the desired configuration as explained above and is ready for use.

In some cases it may be desirable to make the lap cover in two halves divided along or near the longitudinal axis of the elongate body portion for manufacturing convenience or for other reasons. In such case the divided halves are separately attached to the lap surface in a juxtapositioned arrangement giving the impression of an individual lap cover.

I claim:

1. A lap cover for a curved surface lap for grinding lens blanks comprising a substrate sheet of flexible conformable material and a coating of adhesive on one side of the substrate for adhering the substrate to the curved lap surface, said lap cover having an elongate body portion having a longitudinal axis within said elongate body, a leading end edge and a terminal end edge and having a plurality of spaced integral elongate appendage portions projecting from the side edges of the body portion and no part of any appendage portion extends beyond said leading end edge, wherein the ends of the slots between said appendage portions define the side edges of the elongate body portion and said side edges do not cross said longitudinal axis, the shape of each of said elongate appendage portion being such that the appendage portions of an adhesively bonded lap cover do not tear away as the leading end of the body portion is stripped back toward the terminal end during removal.

2. The lap cover of claim 1 wherein the radius of curvature at the juncture of the leading edge of each of said elongate appendage portions and the edge of said elongate body portion is at least about 3/16 inch.

3. The lap cover of claim 1 wherein the leading edge of each of said elongate appendage portions is gradually curving.

4. The lap cover of claim 3 wherein the included angle between a tangent drawn to any point on said gradually curving edge and said longitudinal axis of said elongate body portion is 90° or less.

5. The lap cover of claim 1 wherein the included angle between said longitudinal axis of said elongate body portion and the leading edge of each appendage portion is 90° or less.

6. The lap cover of claim 3 wherein said material is fabric and wherein the included angle between a tangent drawn to any point on said gradually curving edge and said longitudinal axis of said elongate body portion is 125° or less.

7. The lap cover of claim 1 wherein said material is fabric and the included angle between the longitudinal axis of said elongate body and the leading edge of each of said appendage portions is 125° or less.

8. A lap cover according to claim 1 wherein said appendage portions are arranged in opposed relationship.

9. A lap cover according to claim 1 wherein said substrate is coated on the surface opposite that coated with adhesive with abrasive particles in a suitable binder.

10. The lap cover according to claim 1 wherein said substrate is a flocked fabric sheet.

11. The lap cover of claim 1 wherein said adhesive is a rubber:resin adhesive.

12. A method of making a lap cover for grinding lens blanks comprising the steps of (1) preparing an adhesive coated substrate, (2) cutting said sheet to provide a lap cover having an elongate body portion having a longitudinal axis within the elongate body, a leading end and a terminal end and having a plurality of equally spaced integral appendage portions of equal size projecting from the side edges of the body portion with the slots between appendage portions being the same shape as but complementary to the shape of said appendage portions so that adjacent lap covers cut from the same sheet can be cut with little or no wasted material.

13. The method of claim 12 further including the step of applying a release liner to said adhesive coating.

14. The method of claim 12 further including the step of coating the surface of said sheet opposite the surface coated with adhesive with a mixture of abrasive particles in a suitable curable binder and curing said binder to provide an abrasive coating.

15. The method of claim 12 further including the step of flocking the surface of said sheet opposite the adhesive coated surface.

16. A lap cover for a curved surface lap for grinding lens blanks comprising a substrate sheet of flexible conformable material and a coating of rubber:resin adhesive on one side of the substrate for adhering the substrate to the curved lap surface, said lap cover having an elongate body portion having a longitudinal axis within the elongate body, a leading end edge and a terminal end edge and having a plurality of spaced integral elongate appendage portions projecting from the side edges of the body and no part of any appendage portion extends beyond said leading end edge, said appendage portions being of equal size and shape and arranged in opposed relationship and the slots between appendage portions being of a complementary shape so that the adjacent lap covers cut from the same sheet can be cut with little or no wasted material, and wherein the included angle between said longitudinal axis of said elongate body portion and the leading edge of each appendage portion is 90° or less.

* * * * *